US005236652A

United States Patent [19]

Kidder

[11] Patent Number: 5,236,652

[45] Date of Patent: Aug. 17, 1993

[54] PROCESS FOR MAKING POLYAMIDE FIBER USEFUL AS STAPLE FOR PAPERMAKING MACHINE FELT

[75] Inventor: David R. Kidder, Seaford, Del.

[73] Assignee: E. I. Du Pont de Nemours and Company, Wilmington, Del.

[21] Appl. No.: 834,021

[22] Filed: Feb. 11, 1992

[51] Int. Cl.[5] ..... D01F 1/10; D01F 6/26

[52] U.S. Cl. ..... 264/211; 264/211.21

[58] Field of Search ..... 264/211, 211.21

[56] References Cited

U.S. PATENT DOCUMENTS

| | | | |
|---|---|---|---|
| 3,876,725 | 4/1975 | Wells et al. | 264/211 X |
| 4,360,617 | 11/1982 | Müller et al. | 524/101 |
| 4,624,679 | 11/1986 | McEntee | 8/650 |
| 4,874,660 | 10/1989 | Davis et al. | 428/234 |

OTHER PUBLICATIONS

Translation of German 1,719,312 (published Feb. 10, 1972).

Ciba-Geigy Technical Bulletin—Irganox 1098—Antioxidant and heat Stabilizer—Published 1981.

Ciba-Geigy Technical Bulletin—Irganox B-Blends—Published 1986.

Derwent Abstract 90-180553/24, "Paper machine felts made from polyamide 11 fibre, showing enhanced durability and chemical resistance" (1990).

*Primary Examiner*—Leo B. Tentoni

[57] ABSTRACT

The invention provides a process for making polyamide fiber with high molecular weight and/or chemical and thermal resistance using conventional single or twin screw extruders. The process includes melt-blending polyamide polymer comprising at least about 75% by weight of poly(hexamethylene adipamide) or poly(ε-caproamide) and having a formic acid relative viscosity of about 20 to about 50 with a polyamide additive concentrate comprising polyamide polymer and an additive selected from the class consisting of stabilizers, catalysts and mixtures thereof to form a molten polymer which contains about 0.05 to about 2 weight % of the additive and extruding the molten polymer from a spinneret and forming a fiber having a denier per filament of 1 to 40. Fibers made by this process have great utility in the batt of papermaking machine felts where they provide improved resistance to wear and/or chemical attack.

11 Claims, No Drawings

PROCESS FOR MAKING POLYAMIDE FIBER USEFUL AS STAPLE FOR PAPERMAKING MACHINE FELT

BACKGROUND OF THE INVENTION

This invention relates to processes for making polyamide fiber and more particularly to a process for making polyamide fiber which contains additives including catalysts, stabilizers or both and the products made thereby which are particularly useful as staple for papermaking machine felt.

Stabilizers are often added to polyamides such as nylon 66, poly(hexamethylene adipamide), and nylon 6, poly(ε-caproamide), for the purpose of reducing thermal degradation and chemical attack. High levels of such stabilizers are desirable when the intended use of such fiber is in an environment with particularly harsh conditions. One such use of polyamide fiber is as staple used as in papermaking machine felts. Such felts are often exposed to highly alkaline, oxidizing aqueous solutions which can seriously shorten the service life of the felt.

There are several known methods for adding the stabilizing agents to polyamides. One method is to introduce a solution of the stabilizer into an autoclave during the polymerization step. The amount of stabilizer which can be introduced by this method is limited, however, due to the violent foaming that occurs during autoclave polymerization when stabilizers are added in solution form. A similar reaction occurs when large amounts of stabilizer solutions are added to continuous polymerizers. The normal maximum concentration in polyamides on commercial autoclaves and continuous polymerizers using this method is typically 0.05 weight %.

For fiber to be used for papermaking machine felts, it is also desirable sometimes to spin polyamides which have a high formic acid relative viscosity to improve resistance to wear from flexing, impact and abrasion. It has been demonstrated that an increase in molecular weight of a polyamide will increase the toughness, modulus of elasticity, and impact resistance. However, when the polyamide supply for such fiber is polyamide flake, it is often difficult to obtain the desired high relative viscosity while maintaining polymer quality, i.e., low level of cross-branching. While it would be desirable to increase the relative viscosity in the flake by using a high quality of catalyst in an autoclave, it has been found that difficulties similar to those encountered with stabilizers can occur when attempting to add catalysts in high quantity. In addition, high quantities of catalyst in the autoclave can cause severe injection port pluggage and complications to injection timings during autoclave cycles. High quantities of catalysts injected into continuous polymerizers place stringent demands on equipment capability because of high levels of water-loading.

SUMMARY OF INVENTION

The invention provides a process for making polyamide fiber including:

melt-blending polyamide polymer comprising at least about 75% by weight of poly(hexamethylene adipamide) or poly(ε-caproamide) and having a formic acid relative viscosity of about 20 to about 50 with a polyamide additive concentrate comprising polyamide polymer and an additive selected from the class consisting of stabilizers, catalysts and mixtures thereof to form a molten polymer which contains about 0.05 to about 2 weight % of the additive; and extruding the molten polymer from a spinneret to form a fiber having a denier per filament of 1 to 40.

In one preferred form of the invention, the additive is a catalyst selected from the class consisting of alkali-metal, alkyl-substituted and/or aryl-substituted phosphites; alkali-metal, alkyl-substituted and/or aryl-substituted phosphates; alkyl-substituted and/or aryl-substituted phosphonic acids; alkyl-substituted and/or aryl-substituted phosphinic acids; and mixtures thereof and the relative viscosity of the polyamide polymer is increased prior to extruding. Most preferably, the relative viscosity of the polymer is increased by at least about 30 units and is increased such that the residence time of the additive in the molten polymer before extruding is not more than about 60 minutes.

In another preferred form of the invention, the additive is a stabilizer selected from the class consisting of alkyl-substituted and/or aryl-substituted phenols; alkyl-substituted and/or aryl-substituted phosphites; alkyl-substituted and/or aryl-substituted phosphonates; and mixtures thereof.

The invention is capable of adding high amounts of stabilizers and/or catalysts to polyamides which could not be done effectively otherwise and is particularly desirable for polyamides being processed on single or twin screw-melter extruders. The invention is capable of increasing the relative viscosity of a polyamide while maintaining excellent polymer quality.

DETAILED DESCRIPTION

Polyamides used for the main polymer source in the process in accordance with the invention and which constitute the resulting fibers are at least about 75 weight % poly(hexamethylene adipamide) (nylon 66) or at least about 75 weight % poly(ε-caproamide) (nylon 6). Generally, for industrial use where strength and thermal stability are important, it is preferable for the amount of comonomers and other polyamides mixed with the poly(hexamethylene adipamide) or poly(ε-caproamide) to be less than about 5 weight %. Because of a balance of properties including dimensional stability which is imparted to the resulting fiber and reasonable melt-processing temperatures, homopolymer poly(hexamethylene adipamide) (6,6 nylon) is the most preferred polyamide for the main polymer source in the practice of the present invention. The formic acid relative viscosity of the main polyamide used is about 20 to about 50.

The additive concentrates useful in accordance with the present invention can contain one or more of a wide variety of generally linear, aliphatic polycarbonamide homopolymers and copolymers. For example, homopolymer poly(hexamethylene adipamide) (nylon 66), poly(ε-caproamide) (nylon 6), and poly(tetramethylene adipamide) (nylon 46) can be used. Other polyamides which may be used are poly(aminoundecanoamide), poly(aminododecanoamide), polyhexamethylene sebacamide, poly(p-xylylene-azeleamide), poly(m-xylylene adipamide), polyamide from bis(p-aminocyclohexyl)methane and azelaic, sebacic and homologous aliphatic dicarboxylic acids. Copolymers and mixtures of polyamides also can be used. It is preferable for the polyamide used in the concentrate to have a melting point not more than the melting point of the main polyamide and a similar melt viscosity to the main polyamide to facilitate the melt-blending step of the process which will be explained in more detail hereinafter.

When the fiber is for use as felt in a papermaking machine, it is preferable for both the main polyamide and the concentrate to be free of the copper (often added as CuI to polyamides for the purpose of ultraviolet radiation protection) since the presence of copper in the felt fiber catalyzes chemical degradation of the fiber when exposed to chemical compounds such as hypochlorite bleach used in the papermaking process.

The additive in the concentrate is a stabilizer, catalyst or mixture of a stabilizer and a catalyst. Preferred stabilizers are alkyl-substituted and/or aryl-substituted phenols; alkyl-substituted and/or aryl-substituted phosphites; alkyl-substituted and/or aryl-substituted phosphonates; and mixtures thereof. Preferred catalysts are alkali-metal, alkyl-substituted, and/or aryl-substituted phosphites; alkali-metal, alkyl-substituted, and/or aryl-substituted phosphates; alkyl-substituted and/or aryl-substituted phosphonic acids; alkyl-substituted and/or aryl-substituted phosphinic acids; and mixtures thereof.

Most preferably, the additive is 1,3,5-trimethyl-2,4,6-tris (3,5-tertbutyl-4-hydroxybenzyl) benzene (sold by Ciba-Geigy under the trademark IRGANOX 1330), N,N'-hexamethylene bis (3,5-di-tert-butyl-4-hydroxyhydro-cinnamamide) (sold by Ciba-Geigy under the trademark IRGANOX 1098, and tris (2,4-di-tert-butylphenyl) phosphite (sold by Ciba-Geigy under the trademark IRGAFOS 168 in combination with IRGANOX antioxidants, e.g., IRGANOX B 1171 is a mixture of IRGAFOS 168 and IRGANOX 1098 in equal quantities by weight.) It should be noted that alkali-metal, alkyl-substituted, and/or aryl-substituted phosphites such as the compound tris (2,4-di-tert-butylphenyl) phosphite (IRGAFOS 168) can operate as both a stabilizer and a catalyst and, if desired, a mixture of compounds can be used to provide both stabilizer and catalyst functions.

The additive concentrates are made from polyamide polymer and the additives using an intermixer such as a Hogarth blender or the components are melt-blended in a twin screw extruder or like device. The molten mixture is then cast as flake or pellets. Preferably, the amount of additive in the concentrate is about 1 to about 40 weight %.

The concentrate is melt-blended with polyamide from the main polymer source to form a molten polymer which contains about 0.05 to about 2 weight % of the additive, preferably, about 0.1 to about 0.7 weight %. This is preferably accomplished by mixing the polymer from the main source with the concentrate with both in solid particulate form to provide a particulate blend prior to melt-blending. The appropriate proportions of the main polyamide and the concentrate are provided by metering using a gravimetric or volumetric feeder for the concentrate which meters the concentrate through an opening into the main polymer flake supply chute supplying the feed zone of the extruder. A single or twin screw-melter/extruder is suitable for melt-blending. The resulting molten polymer is preferably directly supplied to the polymer transfer line piping for conveyance to the spinneret and, if desired, can be blended further in the transfer line there using inline static mixers such as those sold under the trademark KENICS or under the trademark KOCH, flow inverters or both.

Other methods for melt-blending can be used such as mixing molten polymer from the main source with a molten concentrate or any other appropriate method which provides a homogenous molten polymer mixture containing the additive.

After extrusion into the transferline, the polyamide mixture is supplied by metering pump to a spinneret and extruded and formed into fiber. This can be accomplished using techniques which are well known in the art. For use as staple for papermaking machine felt, the polymer is extruded then drawn as a multifilament yarn or tow and cut to form staple as is also known in the art. The resulting staple fiber can be used in the known manner, e.g., incorporated into a felt for a papermaking machine.

When the additive is a catalyst for the purpose of increasing the formic acid relative viscosity (RV), it is preferable for the relative viscosity to be increased by at least about 30 RV units. In addition, to minimize the opportunity for polymer degration, the melt blending should be performed in close proximity to said spinneret, e.g., just prior to the transfer line which supplies the polymer to the metering pumps for the spinnerets. Preferably, the average residence time of the catalyst in said molten polymer before extruding is not more than about 60 minutes. For the increase in relative viscosity to occur efficiently in the transfer line in the preferred embodiment of the invention, the polyamide has a low water content, preferably less than 0.03 weight % when the average hold up time in the transfer line is 5 to 7 minutes. It is possible to increase the relative viscosity to extremely high levels, e.g., from 60 RV to 216 RV with a under such conditions.

The relative viscosity increase can be controlled to a desired level by modifying the proportions of the supply polymer and concentrate, moisture level and concentration of catalyst in the concentrate. Moisture level can be controlled by flake conditioning before melt-blending and by venting during melt-blending. Because this form of the invention increases relative viscosity only in the transfer line, there is no need for specially modified separator/finisher equipment, etc. on continuous polymerizers or solid phase polymerization or additional flake conditioning capacity on flake-fed melt extruder systems.

Polyamide fiber in accordance with the invention is useful as staple for papermaking machine felt. The fiber denier per filament is 1 to 40 and comprises at least 75 weight % poly(hexamethylene adipamide) polymer. The polymer contains about 0.1 to about 2.0 weight % of a stabilizer selected from the class consisting of 1,3,5-trimethyl-2,4,6-tris (3,5-tertbutyl-4-hydroxybenzyl) benzene, N,N'-hexamethylene bis (3,5-di-tert-butyl-4-hydroxyhydro-cinnamamide), and tris (2,4-di-tert-butylphenyl) phosphite and mixtures thereof, the fiber being substantially free of copper. Preferably, the fiber contains about 0.1 to about 0.7 weight % of the stabilizer. In the fiber, the stabilizer is preferably thoroughly mixed with the polyamide in the fiber.

Preferably, the formic acid relative viscosity of the polyamide of the fiber is at least about 20, most preferably, at least about 35. The most preferred polyamide is at least about 95% poly(hexamethylene adipamide).

Fiber in accordance with the invention used as staple in the batt of papermaking machine felts provides increased service life when compared to conventional staple fiber.

TEST METHODS

Relative viscosity of polyamides refers to the ratio of solution and solvent viscosities measured in capillary viscometer at 25° C. The solvent is formic acid containing 10% by weight of water. The solution is 8.4% by weight polyamide polymer dissolved in the solvent.

Denier: Denier or linear density is the weight in grams of 9000 meters of yarn. Denier is measured by forwarding a known length of yarn, usually 45 meters, from a multifilament yarn package to a denier reel and weighting on a balance to an accuracy of 0.001 g. The denier is then calculated from the measured weight of the 45 meter length.

Tensile Properties: Tenacity and Elongation to break are measured as described by Li in U.S. Pat. No. 4,521,484 at col. 2, line 61 to col. 3, line 6. % Work to Break is the area under the stress-strain curve.

EXAMPLES

In the examples which follow, the additives are identified by their trademarks as indicated below:

1,3,5-trimethyl-2,4,6-tris (3,5-tertbutyl-4-hydroxybenzyl) benzene-IRGANOX 1330

N,N'-hexamethylene bis (3,5-di-tert-butyl-4-hydroxyhydro-cinnamamide)-IRGANOX 1098

Tris (2,4-di-tert-butylphenyl) phosphite in equal quantities with IRGANOX 1098-IRGANOX B 1171

EXAMPLE 1

The staple fibers shown in Table 1 were made by volumetrically metering concentrate pellets of 20% IRGANOX B 1171 co-melted with 80% mixed polyamide carrier (sold by Du Pont under the trademark ELVAMIDE) into the main polyamide flake (homopolymer nylon 66) feed at a rate such that the particulate mixture contains 0.4 weight % IRGANOX B 1171. The concentrate pellets and main polyamide were then melted-blended at 290° C. in a vented, twin screw extruder. The polymer was extruded into a transfer line with a 5 to 7 minute holdup time to a manifold feeding meter pumps at 80 pounds per hour per position. The polymer relative viscosity was 68–72 controlled by varying the vacuum on the barrel of the twin screw. The fiber was extruded through spinnerets in filament form, air quenched, coated with finish (1.0% to 1.5%) and partially drawn to 60 dpf. The spun fibers were then collected in tow form, drawn and crimped to 15 dpf using a 4.0 draw ratio on a draw crimper. The drawn/crimped fibers were crimp set in a steam autoclave at 135° C., dried, then cut as 3 inch staple using a lumus cutter. The fibers had a tenacity of 4.0 to 6.0 gpd and an elongation to break of 80%–100%. The same technique was used to make the different concentrations of IRGANOX 1330 and IRGANOX 1098 in nylon 66 shown in Table 1 except the stabilizer concentrate pellets were made by combining 20% stabilizer with homopolymer nylon 6 instead of the mixed polyamide carrier sold under the trademark ELVAMIDE.

Test fibers made as described above were exposed to 1000 ppm NaOCl @ 80° C., 72 hrs; 3% $H_2O_2$ @ 80° C., 72 hrs; and dry heat @ 130° C. for 72 hrs. Denier, tenacity and elogation of each test fiber was checked before and after exposure to the chemical and dry heat tests. The % work to break (area under stress strain curve) change was determined and is an index of the increased protection provided by the addition of stabilizers in accordance with the invention compared with a control with no stabilizer. A summary of results is shown in Table 1.

TABLE 1

| 15 dpf Nylon 66 Sample Description | Chemical Stability % Retained Work-To-Break NaOCl | Chemical Stability % Retained Work-To-Break $H_2O_2$ | Dry Heat Stability % Retained Work-To-Break 130° C. 72 Hours |
|---|---|---|---|
| Control | 9 | 23 | 20 |
| Nylon 66 +0.4 weight % IRGANOX B1171 | 27 | 61 | 91 |
| Nylon 66 +0.05 weight % IRGANOX 1330 | 13 | 30 | 64 |
| Nylon 66 +0.2 weight % IRGANOX 1330 | 9 | 22 | 54 |
| Nylon 66 +0.3 weight % IRGANOX 1098 | 7 | 71 | 100 |

EXAMPLE 2

This example illustrates the significant increase in relative viscosity that is possible when a catalyst is used in a process in accordance with the invention. A 10 weight % concentrate of IRGANOX B 1171 in a mixed polyamide carrier (sold by Du Pont under the trademark ELVAMIDE) is melt-blended with homopolymer nylon 66 that has a weight % water of less than 0.03% in a twin screw extruder. The amount of water the nylon 66 is reduced prior to melt-blending by flake conditioning. As shown in Table 2, the relative viscosity is increased by the volumetric feeding of IRGANOX B 1171 concentrate pellets into the main nylon 66 flake feed when the weight % water in the polyamide flake is at the reduced level of less that about 0.03 weight %. Staple fiber was made as in Example 1. There was no increase in the level of machine breaks or broken filaments of the high relative viscosity test item compared to the control.

TABLE 2

| Sample Description | RV | RV Increase |
|---|---|---|
| Control Nylon 66, <0.3% Water With No IRGANOX B 1171 | 60 | — |
| Test Item Nylon 66, <0.3, Water + 0.1 weight % IRGANOX B 1171 | 70–75 | 9–15 |

I claim:

1. A process for making polyamide fiber comprising:

melt-blending polyamide polymer comprising at least about 75% by weight of poly(hexamethylene adipamide) or poly(e-caproamide) and having a formic acid relative viscosity of 20–50 with a polyamide additive concentrate comprising polyamide polymer and about 1 to about 40 weight % of an additive selected from the group consisting of stabilizers, catalysts and mixtures thereof to form a molten polymer which contains about 0.05 to about 2 weight % of said additive; and extruding said molten polymer from a spinneret and forming a fiber having a denier per filament of 1 to 40.

2. The process of claim 1 wherein said additive is a catalyst selected from the group consisting of alkali-metal, alkyl-substituted, and/or aryl-substituted phosphites; alkali-metal, alkyl-substituted, and/or aryl-substituted phosphates; alkyl-substituted and/or aryl-substituted phosphonic acids; alkyl-substituted and/or aryl-substituted phosphinic acids; and mixtures thereof and said relative viscosity of said polyamide polymer is increased prior to extruding from said spinneret.

3. The process of claim 2 wherein said relative viscosity of said polymer is increased by at least about 30 units.

4. The process of claim 2 wherein said melt-blending is performed such that the average residence time of said catalyst in said molten polymer before extruding is not more than about 60 minutes.

5. The process of claim 1 wherein said additive is a stabilizer selected from the group consisting of alkyl-substituted and/or aryl-substituted phenols; alkyl-substituted and/or aryl-substituted phosphites; alkyl-substituted and/or aryl-substituted phosphonates; and mixtures thereof.

6. The process of claim 1 wherein said additive is selected from the group consisting of 1,3,5-trimethyl-2,4,6-tris (3,5-tertbutyl-4-hydroxybenzyl) benzene, N,N'-hexamethylene bis (3,5-di-tert-butyl-4-hydroxyhydro-cinnamamide), and tris (2,4-di-tert-butylphenyl) phosphite and mixtures thereof.

7. The process of claim 1 wherein said fiber is free of copper.

8. The process of claim 1 wherein said resulting molten polymer contains about 0.1 to about 0.7 weight % of said additive.

9. The process of claim 1 wherein said polyamide polymer and said polyamide stabilizer concentrate are in solid particulate form and are mixed together to form a particulate blend prior to melt-blending.

10. The process of claim 1 wherein said melt-blending is performed using a screw-melter.

11. The process of claim 1 wherein said polyamide polymer is homopolymer poly(hexamethylene adipamide).

* * * * *